US011758961B2

(12) United States Patent
Shigematsu

(10) Patent No.: US 11,758,961 B2
(45) Date of Patent: Sep. 19, 2023

(54) HEADWEAR

(71) Applicant: SHIGEMATSU CO., LTD., Osaka (JP)

(72) Inventor: Yoshikatsu Shigematsu, Tokyo (JP)

(73) Assignee: SHIGEMATSU CO., LTD., Osaka (JP)

( * ) Notice: Subject to any disclaimer, the term of this patent is extended or adjusted under 35 U.S.C. 154(b) by 0 days.

(21) Appl. No.: 17/992,076

(22) Filed: Nov. 22, 2022

(65) Prior Publication Data

US 2023/0225442 A1 Jul. 20, 2023

(30) Foreign Application Priority Data

Jan. 14, 2022 (JP) ..... 2022-004215

(51) Int. Cl.
*A42B 1/22* (2006.01)
*A42B 1/0182* (2021.01)

(52) U.S. Cl.
CPC ..... *A42B 1/22* (2013.01); *A42B 1/0182* (2021.01)

(58) Field of Classification Search
CPC ..... A42B 1/22; A42B 1/0182; A42B 1/0181; A42B 1/04; A42B 1/041; A42B 1/206; A42B 1/019; A42B 1/02; A42B 1/225; A42B 1/018; A42C 5/02; A42C 5/00; A41D 20/00

(Continued)

(56) References Cited

U.S. PATENT DOCUMENTS 6,052,831 A * 4/2000 Park ..... A42C 5/02 2/195.3
6,122,774 A * 9/2000 Park ..... A42B 1/22 2/181.2

(Continued)

FOREIGN PATENT DOCUMENTS

JP 60-156132 10/1985
JP 2011-214187 10/2011

(Continued)

OTHER PUBLICATIONS

Decision to Grant a Patent dated Mar. 15, 2022 in corresponding Japanese Application No. 2022-004215 (with English translation).

(Continued)

*Primary Examiner* — Amy Vanatta
(74) *Attorney, Agent, or Firm* — Wenderoth, Lind & Ponack, L.L.P.

(57) ABSTRACT

Headwear includes a crown of planar fabric panels sewn together in-plane, a brim and a size adjuster of a strip of fabric on a lower portion of the crown, around an entirety of a circumference of the crown or a part of the circumference of the crown. The size adjuster includes, in a space defined by a casing formed by the strip of fabric, a shape-changeable component that, at heat of a predetermined temperature or higher, is configured to soften and extend in a circumferential direction of the crown by a length that is greater than a length by which the shape-changeable component extends at heat lower than the predetermined temperature, in response to a tensile force applied to the shape-changeable component in the circumferential direction of the crown. The fabric panels have a contour and a mesh formed by cutting fabric on a bias.

3 Claims, 3 Drawing Sheets

(58) Field of Classification Search
USPC ..... 2/195.1–195.3, DIG. 11
See application file for complete search history.

(56) References Cited

U.S. PATENT DOCUMENTS

| | | | | | |
|---|---|---|---|---|---|
| 6,131,202 | A * | 10/2000 | Yan | A42C 5/02 | 2/195.3 |
| 6,347,410 | B1 * | 2/2002 | Lee | A42C 5/02 | 2/181 |
| 2005/0066420 | A1 * | 3/2005 | Kim | A42B 1/22 | 2/181 |
| 2005/0160518 | A1 * | 7/2005 | Cho | A42B 1/22 | 2/181 |
| 2006/0179543 | A1 * | 8/2006 | Burmester | A42B 1/002 | 2/171 |
| 2008/0109939 | A1 * | 5/2008 | Lee | A42C 5/00 | 2/195.3 |
| 2008/0282448 | A1 * | 11/2008 | Cho | A42C 5/02 | 2/181 |
| 2013/0145519 | A1 * | 6/2013 | Cho | A42B 1/22 | 2/183 |
| 2019/0281917 | A1 * | 9/2019 | Wilson | A42B 1/248 | |

FOREIGN PATENT DOCUMENTS

| | | | |
|---|---|---|---|
| JP | 2021-88800 | | 6/2021 |
| KR | 200299372 | Y1 * | 1/2003 |
| KR | 20110035839 | A * | 4/2011 |
| KR | 10-1619210 | | 5/2016 |
| KR | 20170139813 | A * | 12/2017 |

OTHER PUBLICATIONS

HUMOFIT series introduction document, with partial English translation, available as a publication dated Nov. 1, 2021.

* cited by examiner

HEADWEAR

CROSS REFERENCE TO RELATED APPLICATIONS

The present application is based on and claims priority of Japanese Patent Application No. 2022-004215 filed on Jan. 14, 2022. The entire disclosure of the above-identified application, including the specification, drawings, and claims is incorporated herein by reference in its entirety.

FIELD

The present invention relates to headwear.

BACKGROUND

Conventionally, headwear where the circumferential size of the crown is adjustable has been proposed. Japanese Unexamined Patent Application Publication No. 2021-088800 (hereinafter, "JP 2021-088800") discloses headwear that is adjustable in size by an elastic band provided to a sweat receiving portion.

SUMMARY

Technical Problem

However, it is difficult to adjust the size of the headwear disclosed in JP 2021-088800 by a sufficient length.

In view of this, the present invention provides headwear that can be adjusted in size by a sufficient length.

Solution to Problem

In order to overcome the above-described technical problem, headwear according to one aspect of the present invention includes a crown of planar fabric panels sewn together in-plane, and a brim. The headwear includes a size adjuster of a strip of fabric, the size adjuster being provided on a lower portion of the crown, around an entire circumference or part of the circumference of the crown. The size adjuster includes, in a space defined by a casing formed by the strip of fabric, a shape-changing component that extends in a circumferential direction of the crown by a predetermined length by heat of a predetermined temperature or higher. Each of the fabric panels, the strip of fabric, or each of the fabric panels and the strip of fabric has a contour and a mesh formed by cutting fabric on a bias. At least one of the following are sewn together using elastic thread: (1) the fabric panels; (2) the crown and the brim; and (3) the crown and the size adjuster.

BRIEF DESCRIPTION OF DRAWINGS

These and other advantages and features will become apparent from the following description thereof taken in conjunction with the accompanying Drawings, by way of non-limiting examples of embodiments disclosed herein.

DESCRIPTION OF EMBODIMENT(S)

The headwear according to the present invention includes a size adjuster of a strip of fabric, the size adjuster being provided on a lower portion of the crown, around an entire circumference or part of the circumference of the crown. The size adjuster includes, in a space defined by a casing formed by the strip of fabric, a shape-changing component that extends in a circumferential direction of the crown by a predetermined length by heat of a predetermined temperature or higher. In the headwear according to the present invention, each of the fabric panels, the strip of fabric, or each of the fabric panels and the strip of fabric has a contour and a mesh formed by cutting fabric on a bias, and is sewn together using elastic thread. With this configuration, in the headwear according to the present invention, the size of the crown can be adjusted by a sufficient length, for example, over a length of approximately six centimeters or more, from approximately 55 centimeters to approximately 61 centimeters or more.

Embodiment

Hereinafter, an exemplary embodiment will be described with reference to the drawings.

Structure

Figure 1:
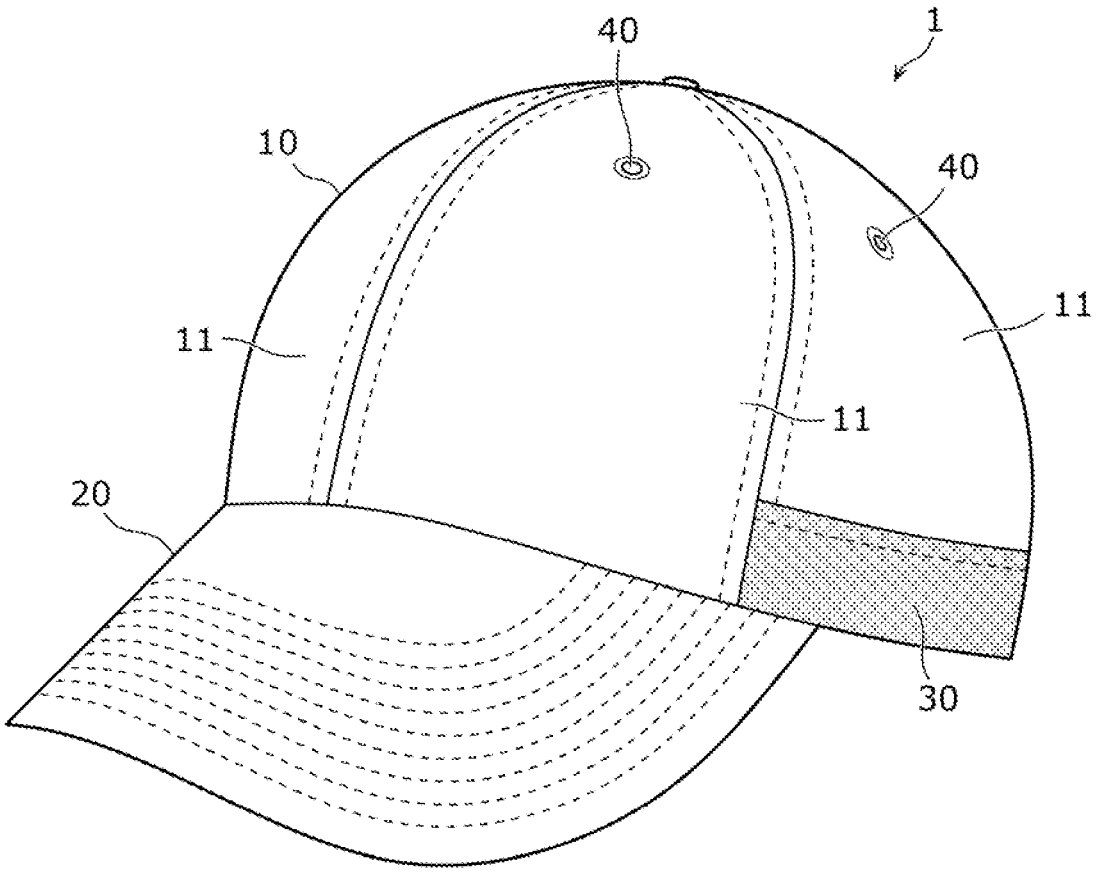
FIG. 1 is a perspective view illustrating the entire headwear according to an exemplary embodiment.

FIG. 1 is a perspective view illustrating the entire headwear 1 according to an exemplary embodiment. Headwear 1 includes crown 10 and brim 20. As used herein, crown 10 refers to the part of headwear 1 that covers the wearer's head, i.e., the side and top surfaces of headwear 1. Brim 20 refers to the part of headwear 1 that protrudes outward from crown 10.

The fabric of headwear 1 may be made of cotton, wool, hemp, a plant-based material, or a synthetic fiber such as polyester, and is a textile that forms the outer surface of headwear 1. The fabric may be, for example, felt fabric or knitted fabric. The fabric may be made from a single sheet of fabric or made from a plurality of fabric panels 11.

Crown 10 of headwear 1 includes size adjuster 30 and one or more eyelets 40. Crown 10 is made of a plurality of planar fabric panels 11 sewn together in-plane.

Size adjuster 30 is a strip of fabric provided on the lower portion of crown 10, around the entire circumference or part of the circumference of crown 10. Size adjuster 30 may be attached to the inside of the perimeter forming the lower portion of crown 10, and, as illustrated in FIG. 1, may be integral with crown 10 so as to form the lower portion of crown 10.

Note that crown 10 of headwear 1 does not include a sweatband. As used herein, a sweatband refers to a strip of fabric provided on the inside of crown 10, around the entire circumference of crown 10.

Figure 2:
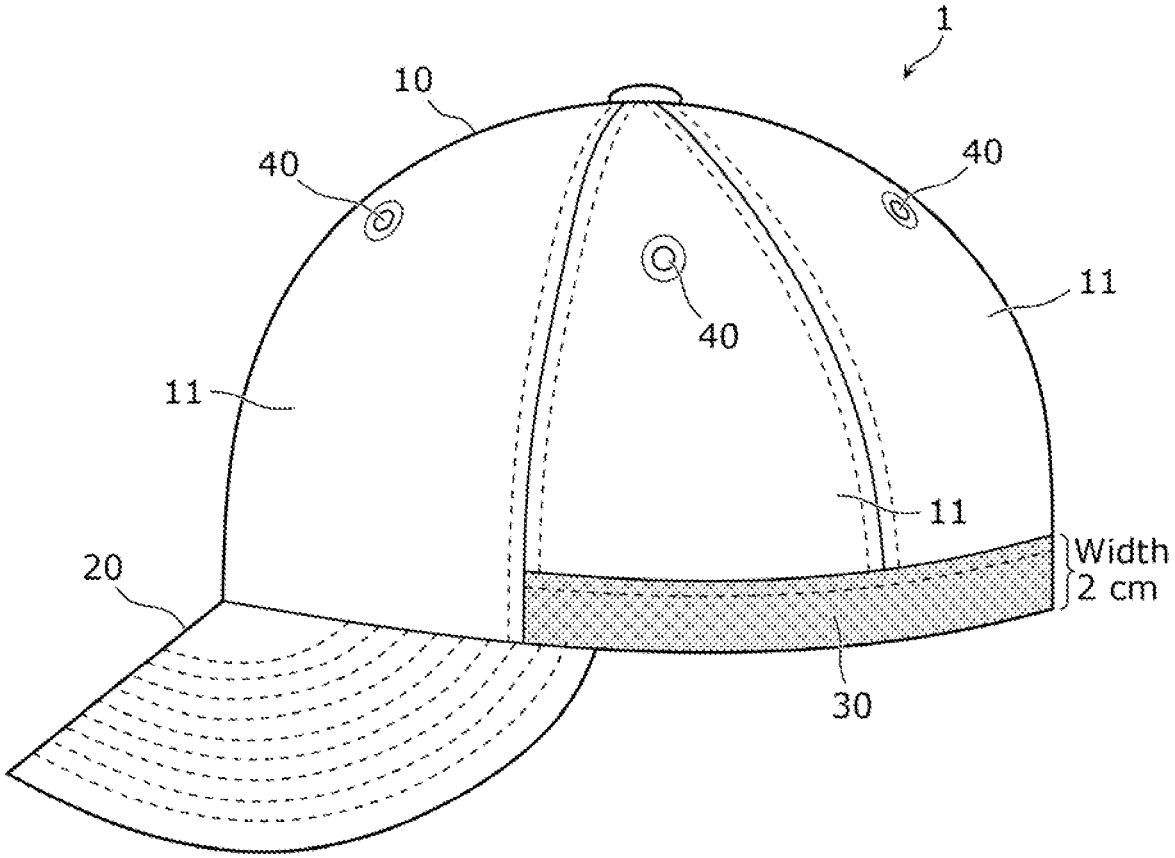
FIG. 2 is a side view illustrating the entire headwear according to an exemplary embodiment.

FIG. 2 is a side view illustrating the entire headwear 1 according to an exemplary embodiment. Size adjuster 30 may have the shape of a 2 cm wide strip. For example, size adjuster 30 may be provided on the lower portion of the back of crown 10. More specifically, size adjuster 30 may be provided in an area of crown 10 where crown 10 does not contact brim 20, in the shape of a 2 cm wide strip at the lower edge of crown 10.

The one or more eyelets 40 included in crown 10 may be provided one per fabric panel 11 of crown 10. For example, when crown 10 includes six fabric panels 11, since each of the six fabric panels 11 includes one eyelet 40, headwear 1 includes a total of six eyelets 40.

Figure 3:
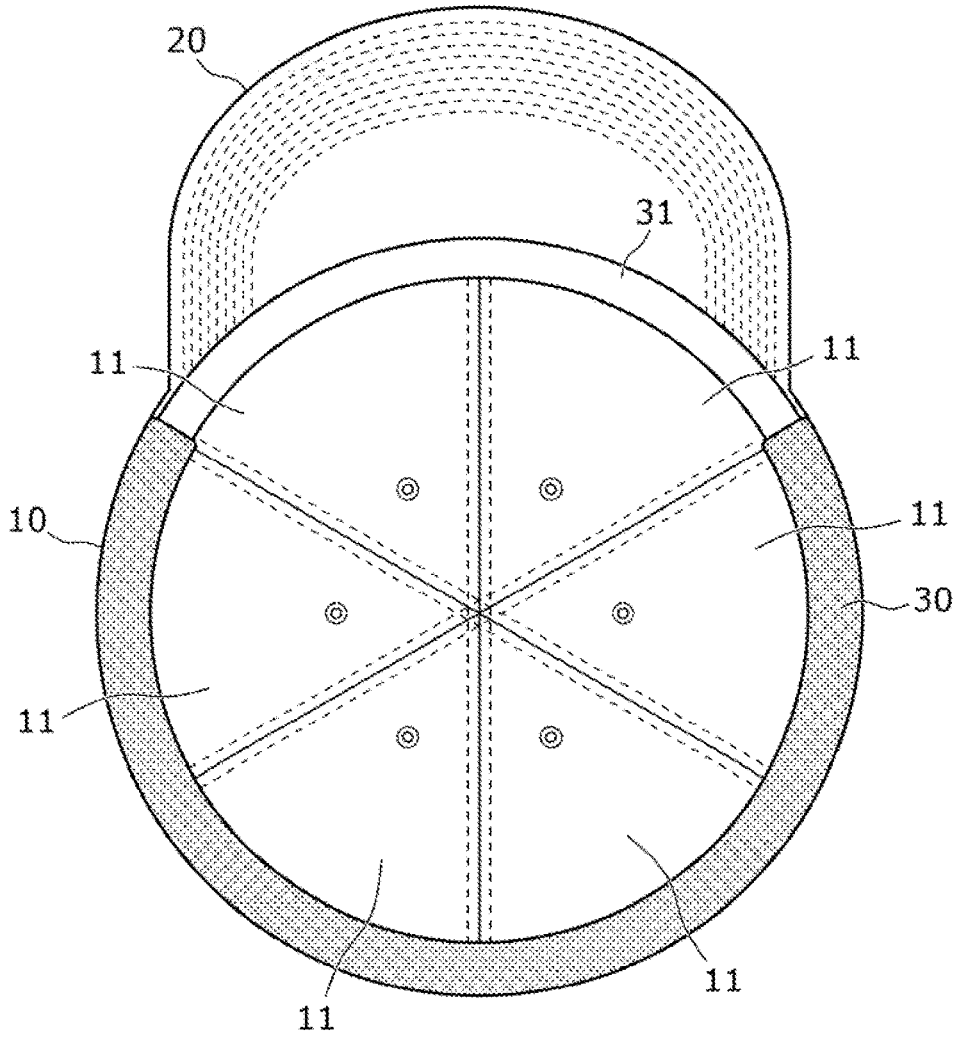
FIG. 3 illustrates the entire circumference of a size adjuster of the headwear according to an exemplary embodiment.

FIG. 3 illustrates the entire circumference of size adjuster 30 of headwear 1 according to an exemplary embodiment. FIG. 3 is a view of headwear 1 from below. As illustrated in FIG. 3, size adjuster 30 may be provided around the entire circumference of the lower portion of crown 10. For the sake of convenience, size adjuster 30 is illustrated in FIG. 3 with its width projected as-is.

Size adjuster 30 may be formed from fabric cut into a strip, and the fabric cut into a strip may be sewn into a casing. Size adjuster 30 includes, provided in the space defined by the casing formed by the strip of fabric, shape-changing component 31 that extends in the circumferential direction of crown 10 by a predetermined length by heat of a predetermined temperature or higher.

Stated differently, headwear 1 includes a strip of fabric sewn so as to form a casing on the lower portion of crown 10, and includes a core inside the sewn casing of the strip of fabric. Here, the core is shape-changing component 31 that extends in the circumferential direction of crown 10 by a predetermined length by heat of a predetermined temperature or higher.

Rather than the circumferential direction of crown 10, shape-changing component 31 may extend in, for example, a direction perpendicular to the circumferential direction of crown 10. Shape-changing component 31 may extend in every direction by heat of a predetermined temperature or higher.

Each fabric panel 11 of crown 10 and/or the strip of fabric of size adjuster 30 has a contour and mesh formed by cutting on the bias, and is sewn with an elastic thread. In other words, each fabric panel 11 of crown 10 and/or the strip of fabric of size adjuster 30 is formed using textile cut on the bias.

As used herein, cutting on the bias means cutting the fabric at a 45 degree angle relative to the warp or weft. Note that cutting on the bias is not limited to cutting exactly at 45 degrees, and includes cuts made at an angle to the warp or weft. With this, each fabric panel 11 of crown 10 and/or the strip of fabric of size adjuster 30 is more elastic than when cut using a normal cutting method.

Figure 4:
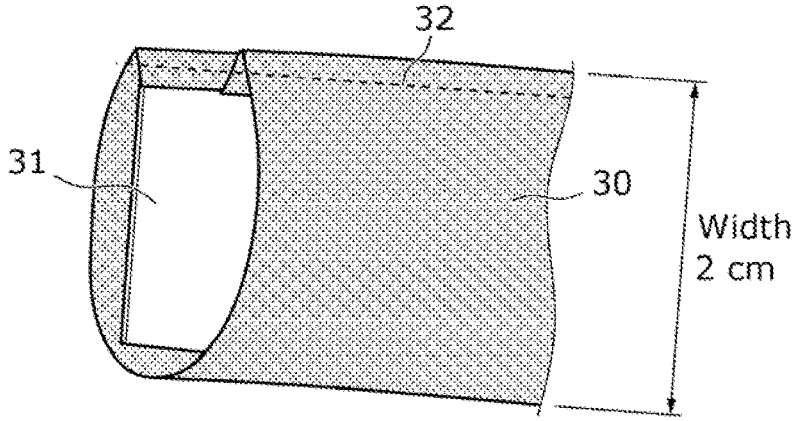
FIG. 4 illustrates a shape-changing component of the headwear according to an exemplary embodiment.

FIG. 4 illustrates shape-changing component 31 of headwear 1 according to an exemplary embodiment. FIG. 4 is a partial view of only size adjuster 30 of headwear 1 and shape-changing component 31 included in size adjuster 30.

As described above, shape-changing component 31 extends in the circumferential direction of crown 10 by a predetermined length by heat of a predetermined temperature or higher. In other words, shape-changing component 31 is a component that can change in shape by reaching a predetermined temperature or higher. More specifically, by reaching a predetermined temperature or higher, shape-changing component 31 can extend in the direction in which tensile force is applied to shape-changing component 31. Here, the predetermined temperature may be, for example, 28 degrees Celsius. For example, shape-changing component 31 starts to soften at 28 degrees Celsius.

For example, shape-changing component 31 may extend a few centimeters to approximately six centimeters in the circumferential direction of crown 10 in response to body heat from the head of the wearer contacting size adjuster 30. Stated differently, shape-changing component 31 may extend, for example, a few centimeters to approximately six centimeters or more in the circumferential direction of crown 10 when subjected to a temperature approximately equal to the body temperature of the head of the wearer. In other words, by shape-changing component 31 extending approximately six centimeters or more, the circumferential size of crown 10 of headwear 1 can be changed from approximately 55 centimeters to approximately 61 centimeters, for example.

At a predetermined temperature or higher, shape-changing component 31 extends in the circumferential direction at a rate according to the tensile force applied to shape-changing component 31 in the circumferential direction. For example, shape-changing component 31 may extend in the circumferential direction of crown 10 due to the body heat of the wearer according to the tension in shape-changing component 31 brought about by the pressure from the wearer's head on size adjuster 30 when the wearer puts headwear 1 on their head.

For example, when shape-changing component 31 is subjected to a temperature approximately equal to the body temperature of the wearer's head, size adjuster 30 extends in the circumferential direction of crown 10 just long enough in the direction in which size adjuster 30 is pulled to conform to the wearer's head to allow size adjuster 30 to conform to the wearer's head.

Shape-changing component 31 remains extended in the circumferential direction of crown 10 while a temperature greater than or equal to the predetermined temperature is kept constant. For example, since the temperature of shape-changing component 31 is kept constant at a predetermined temperature or higher by the body heat of the wearer while the wearer's head is contacting size adjuster 30, shape-changing component 31 remains extended in the circumferential direction at a rate according to the tensile force applied to shape-changing component 31 in the circumferential direction.

For example, once shape-changing component 31 has extended in the circumferential direction of crown 10 in response to the body heat of the wearer, while size adjuster 30 is in contact with the wearer's head and subjected to a temperature approximately equal to the body temperature of the wearer's head, shape-changing component 31 maintains the circumferential extension of crown 10.

At least one of the following are sewn together using elastic thread 32: (1) fabric panels 11; (2) crown 10 and brim 20; and (3) crown 10 and size adjuster 30. Headwear 1 may be sewn together entirely with elastic thread 32. As used herein, elastic thread is, for example, woolly thread.

With this, when shape-changing component 31 is extended in the circumferential direction of crown 10, even if tension is exerted on size adjuster 30 and exerted between fabric panels 11 of crown 10 that are sewn to size adjuster 30, fabric panels 11 and size adjuster 30 and the like can extend slightly as a result of elastic thread 32 stretching. In other words, when shape-changing component 31 is extended in the circumferential direction of crown 10, headwear 1 can accommodate tension exerted on the entire headwear 1.

For example, when shape-changing component 31 is extended in the circumferential direction of crown 10, the strip of fabric of size adjuster 30 extends as shape-changing component 31 extends. Fabric panels 11 forming crown 10 that are stitched to the strip of fabric extend a certain amount as the strip of fabric extends. At this time, elastic thread 32 that stitches the strip of fabric and fabric panels 11 together also stretches as the strip of fabric extends. With this, as a result of the entire headwear 1 extending as shape-changing component 31 extends, the size of headwear 1 can be adjusted significantly more than conventional configurations.

ADVANTAGES

Headwear 1 according to an exemplary embodiment includes crown 10 of planar fabric panels 11 sewn together in-plane, and brim 20. Headwear 1 includes size adjuster 30 of a strip of fabric, size adjuster 30 being provided on a lower portion of crown 10, around an entire circumference or part of the circumference of crown 10. Size adjuster 30 includes, in a space defined by a casing formed by the strip of fabric, shape-changing component 31 that extends in a circumferential direction of crown 10 by a predetermined length by heat of a predetermined temperature or higher. Each of fabric panels 11, the strip of fabric, or each of fabric panels 11 and the strip of fabric has a contour and a mesh formed by cutting fabric on a bias. At least one of the following are sewn together using elastic thread: (1) fabric panels 11; (2) crown 10 and brim 20; and (3) crown 10 and size adjuster 30.

With this configuration, in headwear 1 according to an exemplary embodiment, when size adjuster 30 is subject to a predetermined temperature or higher, size adjuster 30 can sufficiently extend as a result of shape-changing component 31 extending by a predetermined length, and the entire headwear 1 can also sufficiently extend so as to coincide. When shape-changing component 31 extends by a predetermined length, the extension of headwear 1 according to an exemplary embodiment coinciding with the extension of shape-changing component 31 is not hindered by the stitching of all the parts that form headwear 1. Accordingly, headwear 1 according to an exemplary embodiment can adjust its size by a sufficient length.

In headwear 1 according to an exemplary embodiment, at a predetermined temperature or higher, shape-changing component 31 extends in the circumferential direction at a rate according to the tensile force applied to shape-changing component 31 in the circumferential direction.

With this configuration, when size adjuster 30 is subjected to the body heat of the wearer's head, headwear 1 according to an exemplary embodiment can adjust its size so as to fit the size of the wearer's head. Accordingly, headwear 1 according to an exemplary embodiment can adjust its size by a sufficient length.

In headwear 1 according to an exemplary embodiment, shape-changing component 31 remains extended in the circumferential direction of crown 10 while a temperature greater than or equal to the predetermined temperature is kept constant.

With this configuration, while size adjuster 30 is subjected to the body heat of the wearer's head, headwear 1 according to an exemplary embodiment can maintain the size adjustment of headwear 1 so as to fit the size of the wearer's head. Accordingly, headwear 1 according to an exemplary embodiment can adjust its size by a sufficient length.

Hereinbefore, headwear 1 according to the present invention has been described based on an exemplary embodiment, but the present invention is not limited this exemplary embodiment. Various modifications of the exemplary embodiment as well as embodiments resulting from arbitrary combinations of elements of different exemplary embodiments that may be conceived by those skilled in the art are intended to be included within the scope of the present invention as long as they do not depart from the essence of the teachings of the present invention.

The invention claimed is:

1. Headwear comprising:

a crown of planar fabric panels sewn together in-plane;

a brim; and a size adjuster of a strip of fabric, the size adjuster being on a lower portion of the crown, around an entirety of a circumference of the crown or a part of the circumference of the crown, wherein:

the size adjuster includes, in a space defined by a casing formed by the strip of fabric, a shape-changeable component that, at heat of a predetermined temperature or higher, is configured to soften and extend in a circumferential direction of the crown by a length that is greater than a length by which the shape-changeable component extends at heat lower than the predetermined temperature, in response to a tensile force applied to the shape-changeable component in the circumferential direction of the crown;

the fabric panels have a contour and a mesh formed by cutting fabric on a bias such that a direction of the contour and a direction of the mesh intersect at an acute angle; and the fabric panels are sewn together using elastic thread, the crown and the brim are sewn together using elastic thread, or the crown and the size adjuster are sewn together using elastic thread.

2. The headwear according to claim 1, wherein the shape-changeable component is configured to remain extended in the circumferential direction of the crown while a temperature greater than or equal to the predetermined temperature is kept constant.

3. The headwear according to claim 1, wherein the fabric panels are sewn together using elastic thread, the crown and the brim are sewn together using elastic thread, and the crown and the size adjuster are sewn together using elastic thread.

* * * * *